US006454397B1

(12) United States Patent
Hirata

(10) Patent No.: US 6,454,397 B1
(45) Date of Patent: Sep. 24, 2002

(54) INK-JET HEAD AND CONTROL METHOD THEREOF

(75) Inventor: Susumu Hirata, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/678,331

(22) Filed: Oct. 3, 2000

(30) Foreign Application Priority Data

Oct. 27, 1999 (JP) ..... 11-305439

(51) Int. Cl.[7] ..... B41J 2/05
(52) U.S. Cl. ..... 347/64
(58) Field of Search ..... 347/64, 56, 63, 347/61, 54; 216/27, 4, 48; 29/890.1; 430/311

(56) References Cited

U.S. PATENT DOCUMENTS 6,312,111 B1 * 11/2001 Kimura et al.

FOREIGN PATENT DOCUMENTS

JP 62261453 11/1987

* cited by examiner

*Primary Examiner*—Raquel Yvette Gordon
(74) *Attorney, Agent, or Firm*—Birch, Stewart, Kolasch & Birch, LLP

(57) ABSTRACT

An ink-jet head for ejecting ink droplets from a nozzle by the pressure caused by bubbles, includes: a pressure chamber; a multiple number of heating areas for generating bubbles inside the pressure chamber. Heater films arranged in the heating areas are electrically connected in parallel. The thermal conductivity of the insulating film in each heating area is made different from that of the other heating areas so as to produce difference in thermal efficiency between the surfaces facing the pressure chamber so that the heating area closest to the nozzle has the highest thermal efficiency. As a result, heating areas where bubbles should be generated can be selected by varying the applied energy level, whereby it is possible to perform multilevel control of the ejected amount of ink droplets.

9 Claims, 5 Drawing Sheets

INK-JET HEAD AND CONTROL METHOD THEREOF

BACKGROUND OF THE INVENTION (1) Field of the Invention

The present invention relates to a bubble jet type thermal ink-jet technology whereby recording is performed by ejection of ink droplets out of a nozzle by the pressure rise caused by bubbles generated by heat, and in particular relates to an ink-jet recording apparatus for tonal recording.

(2) Description of the Prior Art

For halftone reproduction in the field of ink-jet recording apparatus, there is a method in which the ejected amount of ink droplets is varied. Japanese Utility Model Application Laid-Open Sho 57 No.141043 discloses a circuit which can be applied to varying the amount of ink droplets in a conventional, bubble jet type thermal ink-jet head. This circuit is to vary the ejected amount of ink droplets in conformity with the voltage level of the drive pulse to be applied to the heater. Japanese Patent Application Laid-Open Sho 62 No.261453 discloses an arrangement in which a plurality of heaters are arranged in series in a single pressure chamber and parts of the heaters are selectively turned on at the predetermined timing to heat the ink and generate a bubble of a desired size therein, to thereby eject a desired amount of ink droplets.

When an ink-jet head is configured using the circuit disclosed in Japanese Utility Model Application Laid-Open Sho 57 No.141043, for the case of a single heater, the relationship between the applied energy and the ejected amount of ink droplets as shown in FIG. 8 holds. Actually, there exists a plateau region in which the amount of ink droplets varies very little with increase in applied voltage, in excess of a certain applied voltage level. Therefore, even if the applied voltage is controlled using this circuit, the range in which the amount of ink droplets varies is narrow, hence it is impossible to obtain tonal levels large enough.

According to Japanese Patent Application Laid-Open Sho 62 No.261453, it is possible to change the elected amount of ink droplets over a wide range. However, since independent signals should be applied to drive the multiple heaters, this configuration needs interconnections and driving circuits corresponding to the number of the heaters, hence facing difficulties in making the unit compact and needing more manufacturing cost.

SUMMARY OF THE INVENTION

The present invention has been devised to solve the above problems and it is therefore an object of the present invention to provide an ink-jet head which is able to modulate the amount of ink droplets in a wide range and hence provide sufficient tonal representation.

It is another object of the present invention to provide an ink-jet head which keeps ink ejection from being easily broken due to partial disconnection of the interconnections inside the pressure chamber.

In order to achieve the above object, the present invention is configured as follows:

In accordance with the first aspect of the present invention, an ink-jet head for ejecting ink droplets from a nozzle by the pressure caused by bubbles, includes:

a pressure chamber communicating with the nozzle; and a plurality of heating areas disposed inside the pressure chamber for generating bubbles by heat generation, and is characterized in that heater films arranged in the heating areas are electrically connected in parallel and the surfaces of the heating areas facing the pressure chamber have different thermal efficiencies.

In accordance with the second aspect of the present invention, the ink-jet head having the above first feature is characterized in that each of the heating areas includes an insulating film on the lower side of the heater film and the thermal conductivity of each insulating film is made different from that of the others so as to produce difference in thermal efficiency.

In accordance with the third aspect of the present invention, the ink-jet head having the above first feature is characterized in that each of the heating areas includes an insulating film on the lower side of the heater film and the thickness of each insulating film is made different from that of the others so as to produce difference in thermal efficiency.

In accordance with the fourth aspect of the present invention, the ink-jet head having the above first feature is characterized in that each of the heating areas includes an insulating film on the lower side of the heater film and the ratio of the thermal conductivity to the thickness of the insulating film is made different from that of others so as to produce difference in thermal efficiency.

In accordance with the fifth aspect of the present invention, the ink-jet head having the above first feature is characterized in that each of the heating areas includes a protective film on the upper side of the heater film and the thermal conductivity of each protective film is made different from that of the others so as to produce difference in thermal efficiency.

In accordance with the sixth aspect of the present invention, the ink-jet head having the above first feature is characterized in that each of the heating areas includes a protective film on the upper side of the heater film and the thickness of each protective film is made different from that of the others so as to produce difference in thermal efficiency.

In accordance with the seventh aspect of the present invention, the ink-jet head having the above first feature is characterized in that each of the heating areas includes a protective film on the upper side of the heater film and the ratio of the thermal conductivity to the thickness of the protective film is made different from that of others so as to produce difference in thermal efficiency.

In accordance with the eighth aspect of the present invention, the ink-jet head having any one of the above first through seventh features is characterized in that the heating areas are arranged on a line joining between the nozzle and the ink supply port for supplying ink to the pressure chamber, so that the heating area closest to the nozzle has the highest thermal efficiency and the thermal efficiency varies continuously.

In accordance with the ninth aspect of the present invention, a control method of an ink-jet head, comprises the steps of:

using an ink-jet head for ejecting ink droplets from a nozzle by the pressure caused by bubbles, which comprises:

a pressure chamber communicating with the nozzle; and a plurality of heating areas disposed inside the pressure chamber for generating bubbles by heat generation, wherein heater films arranged in the heating areas are electrically connected in parallel and the surfaces of the heating areas facing the pressure chamber have different thermal efficiencies; and controlling the applied energy to the heating areas in accordance with the density of the image to be recorded so as to vary the amount of ink droplets and perform recording of tones.

Adoption of the above first configuration makes it possible to select heating areas where bubbles should be generated by varying the applied energy level, and hence enables multilevel control of the ejected amount of ink droplets over a wide range of applied energy. As a result, it is possible to realize recording of multiple tones. Since the heater films contained in the heating areas are electrically connected in parallel, if any one of the interconnections connected to one of the heater films is disconnected, the ejection of ink will not be stopped by the disconnection only, thus making it possible to maintain reliable, high printing quality over a long period of time.

Adoption of the above second through seventh configurations makes it possible to easily make a difference in thermal efficiency between the heating areas and hence enables multilevel control of the ejected amount of ink droplets over a wide range of applied energy. As a result, it is possible to realize recording of multiple tones.

In the above eighth configuration, ink is preliminarily heated before the ink reaches the main heating area to a certain degree though it does not reach the temperature at which ink bubbles, through the other heating areas where they have lower thermal conductivities. As a result, the energy required for the ink to bubble in the heating area having a high thermal conductivity can be reduced compared to the case where the heating area having a high thermal conductivity is provided solo.

Adoption of the above ninth configuration enables multilevel control of the ejected amount of ink droplets over a wide range of applied energy. As a result, it is possible to realize recording of multiple tones. Since the heater films contained in the heating areas are electrically connected in parallel, if any one of the interconnections connected to one of the heater films is disconnected, the ejection of ink will not stop only by the disconnection, thus making it possible to maintain reliable, high printing quality over a long period of time.

DESCRIPTION OF THE PREFERRED EMBODIMENTS

The First Embodiment

The ink-jet head of this embodiment is a bubble-jet type recording head, to be applied to a typical ink-jet printer.

(Basic Structure)

Figure 1:
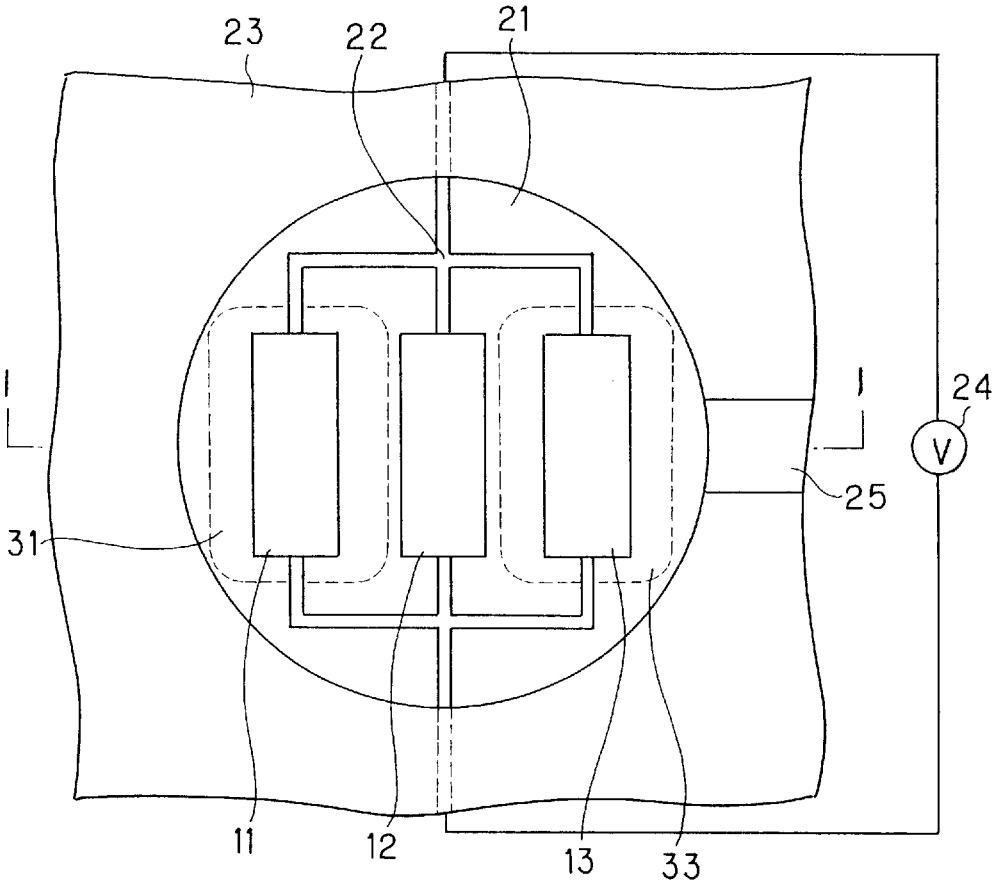
FIG. 1 is a structural diagram showing an ink-jet head of the first embodiment in accordance with the present invention.
Figure 2:
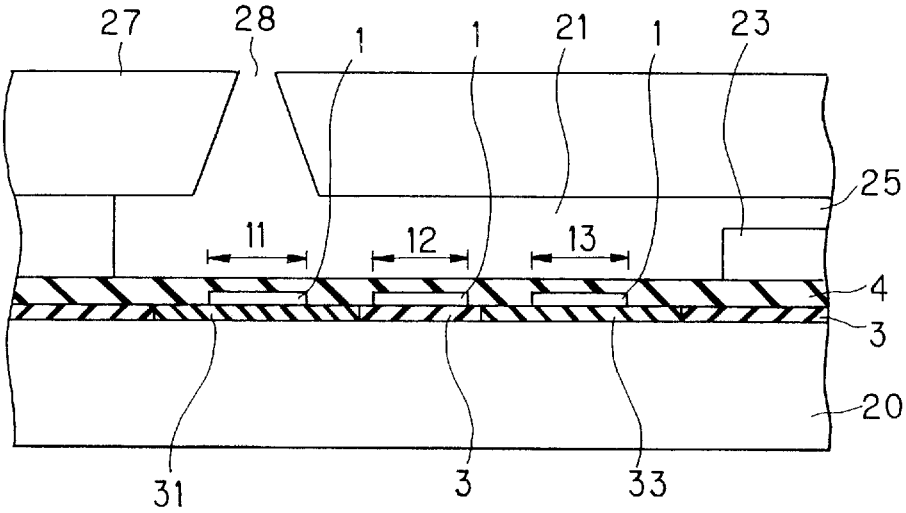
FIG. 2 is a sectional view of the ink-jet head in the first embodiment of the present invention, cut on a plane I—I in FIG. 1.

FIGS. 1 and 2 show the structure of the ink-jet head in this embodiment. FIG. 1 is a structural diagram of the ink-jet head of this embodiment. FIG. 2 is a sectional view of the ink-jet head, cut on a plane I—I in FIG. 1. This ink-jet head includes a substrate 20 and a nozzle plate 27 which oppose each other with a partition wall 23 therebetween, forming a pressure chamber 21, defined by substrate 20, nozzle plate 27 and partition wall 23, for enclosing ink. An ink supply port 25 for supplying ink is provided on one side of pressure chamber 21. Arranged in the center of nozzle plate 27 is a nozzle 28 for ejecting ink.

Heating areas 11, 12 and 13 are arranged facing the interior of pressure chamber 21. Each of heating areas 11, 12 and 13 is made up of an insulating film 3, a heater film 1 and a protective film 4. Insulating film 3 is in contact with substrate 20 and is to provide thermal insulation between heater film 1 and substrate 20 as well as to prevent the pulse current applied to heater film 1 from leaking toward the substrate. Protective film 4 is to prevent the ink inside pressure chamber 21 from directly adhering to heater film 1. As shown in FIG. 1, wire interconnections 22 are connected to both ends of each heater film 1 so as to apply the pulse current from a power source 24.

In this ink-jet head, when recording, heater films 1 are adapted to heat themselves pulse-wise by pulse current. This heat generation instantaneously boils the ink inside pressure chamber 21, producing bubbles therein, whereby ink droplets are ejected from nozzle 28.

(Heating Area Structure)

In this embodiment, as shown in FIGS. 1 and 2, three heating areas 11, 12 and 13 inside pressure chamber 21 are connected in parallel. As seen in FIG. 2, heating areas 11, 12 and 13 have different insulating films located beneath associated heater films 1. In heating area 12, insulating film 3 is provided, while another insulating film 31 is formed in heating area 11, in place of insulating film 3 and still another insulating film 33 is formed in heating area 13, in place of insulating film 3. Insulating films 31 and 33 are almost equal in thickness with insulating film 3 but have different thermal conductivities. The three thermal conductivities of insulating films 31, 3 and 33, namely $\lambda_1$, $\lambda_2$ and $\lambda_3$, have the relationship: $\lambda_1 < \lambda_2 < \lambda_3$.

Here, to vary the thermal conductivity of an insulating film, the film-forming material for the insulating film may and should be changed. For example, insulating film 31 in heating area 11 should be formed of TaN (thermal conductivity: 9.6 J/m.s.k), insulating film 3 in heating area 12 should be formed of $Al_2O_3$ (thermal conductivity: 20.5 J/m.s.k), and insulating film 33 in heating area 13 should be formed of AlN (thermal conductivity: 30.0 J/m.s.k). With this selection, the thermal conductivities $\lambda_1$, and $\lambda_2$ and $\lambda_3$ of insulating films 31, 3 and 33 can have the relationship: $\lambda_1 < \lambda_2 < \lambda_3$.

(Operation and Effect)

Since the thermal conductivity of insulating film 31 corresponding to heating area 11 is the least, heating area 11 will be most unlikely to transfer heat to substrate 20. Accordingly, when three heater films 1 have the same energy simultaneously applied thereto, protective film 4 formed on the top of heater film 1 around heating area 11 undergoes the sharpest temperature rise and hence most quickly runs up to the temperature at which the ink bubbles because heat from heating area 11 will not dissipate through substrate 20. Therefore, the thermal efficiencies, which will indicate the degree of heat released from the surface of protective film 4 being in contact with pressure chamber 21 due to the energy applied to heater film 1 (hereinbelow, when 'thermal efficiency (Th.E.)' is mentioned it should be understood as having this meaning unless otherwise noted) have the relationship: Th.E. in heating area 11>Th.E. in heating area 12>Th.E. in heating area 13.

Since heating areas 11, 12 and 13 are different in thermal efficiency as above, it is possible to generate bubbles in whole or in part in heating areas 11, 12 and 13, by appropriately selecting the energy level applied thereto.

Figure 3:
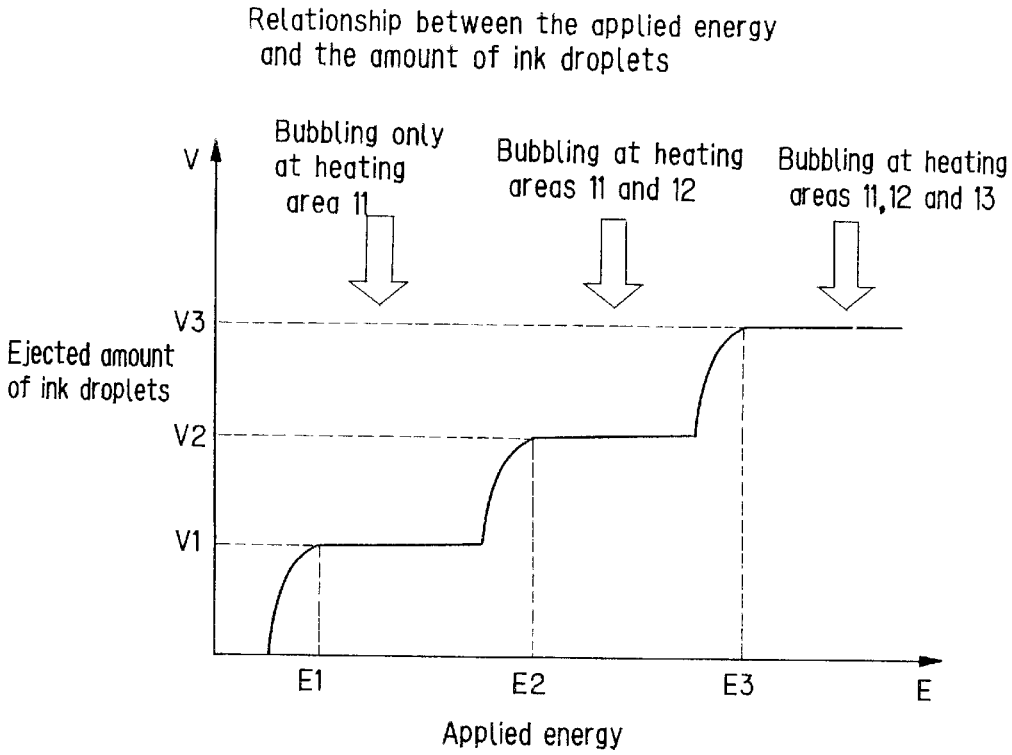
FIG. 3 is a chart showing the relationship between the applied energy and the amount of ink droplets in the ink-jet head of the present invention.
Figure 8:
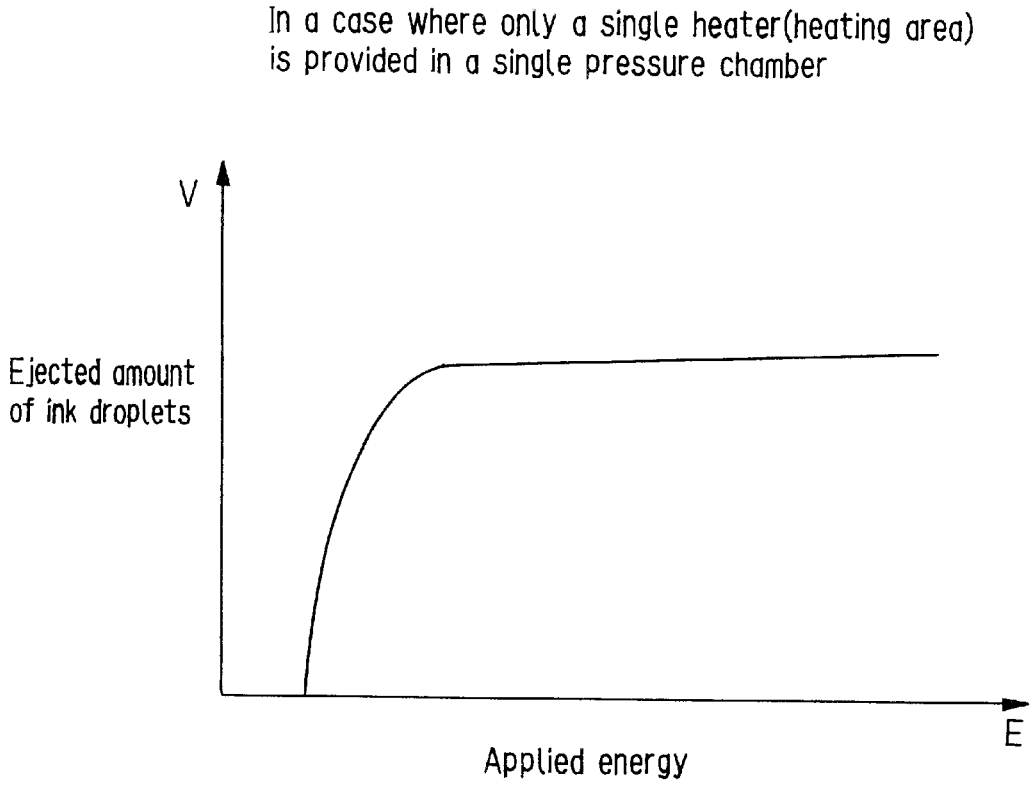
FIG. 8 is a chart showing the relationship between the applied energy and the amount of ink droplets when a single heater is provided in one pressure chamber.

FIGS. 3 and 8 show the relationships between the applied energy and the ink volume (the amount of ink droplets) to be ejected. FIG. 8 is a chart showing the relationship between the applied energy and the ejected amount of ink droplets when a single heating area is provided in one pressure chamber. In the range where the applied energy is low, the amount of ink droplets can be varied depending upon the applied energy. However, as the applied energy becomes higher, the amount of ink droplets varies little. Since the graph shows a steep rise in the range where the applied energy is low and hence the actual amount of ejected ink droplets is affected by variations in performance of individual nozzles, it is difficult to exactly control the amount of ink droplets.

In contrast, FIG. 3 shows the relationship between the applied energy and the ink volume (the amount of ink droplets) to be ejected in the present embodiment. When the applied energy exceeds E1, the ink around heating area 11 bubbles so that a volume V1 of ink droplets ejects from nozzle 28. As the applied energy increases and exceeds E2, the ink around heating areas 11 and 12 bubbles so that a volume V2 of ink droplets, which is twice of volume V1, ejects from nozzle 28. When the applied energy exceeds E3, bubbles become generated at all the heat elements 11, 12 and 13, so that a volume V3 of ink droplets, which corresponds to three times of the volume V1, ejects out of nozzle 28. It is possible to increase the volume of ink droplets to be ejected, four times, five times, six times and so on, as the number of heating areas and the applied energy are increased.

Since there are flat portions in the chart in FIG. 3, this feature facilities control on the amount of ink droplets even when there are variations in the performances of nozzle 28 and heater films 1. Further, since multiple heater films 1 are connected in parallel, if any one of interconnections 22 connected to one of heater films 1 is disconnected, the other heater films 1 can continue to be supplied with energy so that there is no risk of ejection of ink droplets abruptly stopping. Accordingly, when printing, it is possible to avoid occurrence of printing failures such as white spots, white lines, etc., thus making it possible to maintain reliable, high printing quality over a long period of time.

Moreover, since the same signal is applied to multiple heater films 1 in single pressure chamber 21 to drive them, there is no need to provide interconnections and driver circuits corresponding to the number of heater films, which would be needed in the ink-jet head disclosed in Japanese Patent Application Laid-Open Sho 62 No.261453, hence it is possible to make the apparatus compact and reduce the manufacturing cost.

The material for forming the insulating films should not be limited to those mentioned above. So other combinations of materials may be used as long as they can provide different thermal conductivities. For example, if PI(thermal conductivity: 0.174 J/m.s.k) and $SiO_2$ (thermal conductivity: 1.35 J/m.s.k) are used, application of a lower energy can generate bubbles to eject out the ink. In contrast, when $Si_3N_4$ (thermal conductivity: 35.5 J/m.s.k) is used, it is possible to provide a heating area which will need a greater energy to generate bubbles to eject the ink out. Further, if materials having different thermal conductivities over a wide range are used in combination to provide many heating areas in a single pressure chamber 21, multi-level control of the ejected amount of ink droplets can be made over a wide range of applied energy. As a result, it is possible to provide a recording apparatus capable of recording multiple tones.

The Second Embodiment (Structure)

Figure 4:
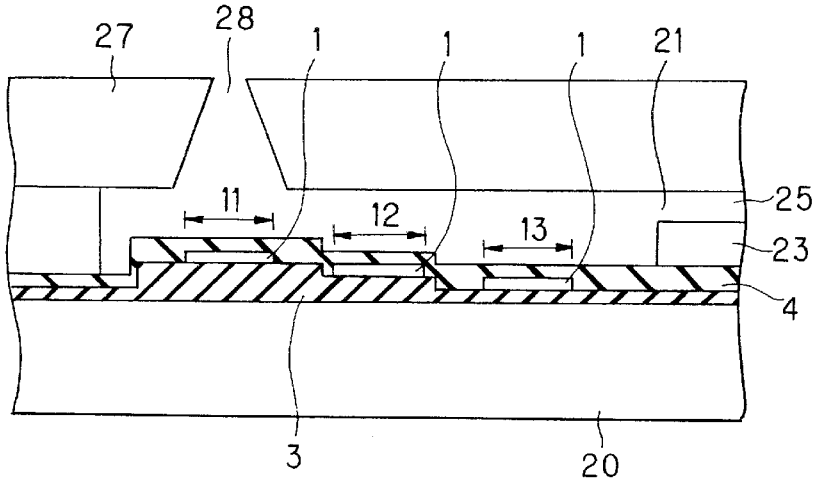
FIG. 4 is a sectional view showing an ink-jet head of the second embodiment in accordance with the present invention.

FIG. 4 shows a structure of an ink-jet head in this embodiment. The basic configuration is the same as that in the first embodiment. In this embodiment, however, the insulating films of heating areas 11, 12 and 13 have the same thermal conductivity and are different in thickness. The three thicknesses of insulating films 3 of heating areas 11, 12 and 13, namely $d_i$, $d_2$ and $d_3$, have the relationship: $d_1>d_2>d_3$. For example, it is possible to provide a specific configuration with $d_1=15$ $\mu$m, $d_2=10$ $\mu$m, and $d_3=5$ $\mu$m.

(Operation and Effect)

Since insulating film 3 corresponding to heating area 11 is the thickest, heating area 11 will be most unlikely to transfer heat to substrate 20. Accordingly, when three heater films 1 simultaneously have the same energy applied thereto, protective film-4 formed on the top of heater film 1 around heating area 11 undergoes a sharpest temperature rise and hence most quickly runs up to the temperature at which the ink bubbles because heat from heating area 11 will not dissipate through substrate 20. Therefore, the thermal efficiencies have the relationship: Th.E. in heating area 11>Th.E. in heating-area 12>Th.E. in heating area 13.

Since heating areas 11, 12 and 13 are different in thermal efficiency as above, it is possible to generate bubbles in whole or in part in heating areas 11, 12 and 13, by appropriately selecting the energy level applied thereto. Therefore, the same relationship as that of the first embodiment shown in FIG. 3 holds between the applied energy and the volume of the ejected ink (the amount of ink droplets), and hence the same effect as in the first embodiment can be obtained.

The thickness of the insulating film should not be limited to the above specifications. But, a number of insulating films having stepwise varying thicknesses such as ten steps of thicknesses, within a wide range of 1 to 100 $\mu$m, for example, may be provided to form many heating areas in a single pressure chamber 21. In this case, it becomes possible to perform multilevel control of the ejected amount of ink droplets over a wide range of the applied energy. As a result, it is possible to provide a recording apparatus capable of recording multiple levels of tones.

It is also possible to add the idea of the first embodiment to this embodiment. That is, it is possible to form a multiple number of heating areas having different thermal efficiencies by changing the ratio of $\lambda_i$ to $d_i$ ($\lambda_i/d_i$), where $\lambda_i$ and $d_i$ are the thermal conductivity and the thickness of the insulating film. When $\lambda_i/d_i$ is small, the thermal efficiency is high so that it is possible to eject ink droplets with a small application of energy. Conversely, when $\lambda_i/d_i$ is large, the thermal efficiency is low so that ejection of ink droplets needs a large application of energy. Thus, it is also possible to perform multilevel control of the ejected amount of ink droplets over a wide range of the applied energy by forming a multiple number of heating areas having different thermal efficiencies by varying the ratio $\lambda_i/d_i$.

The Third Embodiment (Structure)

Figure 5:
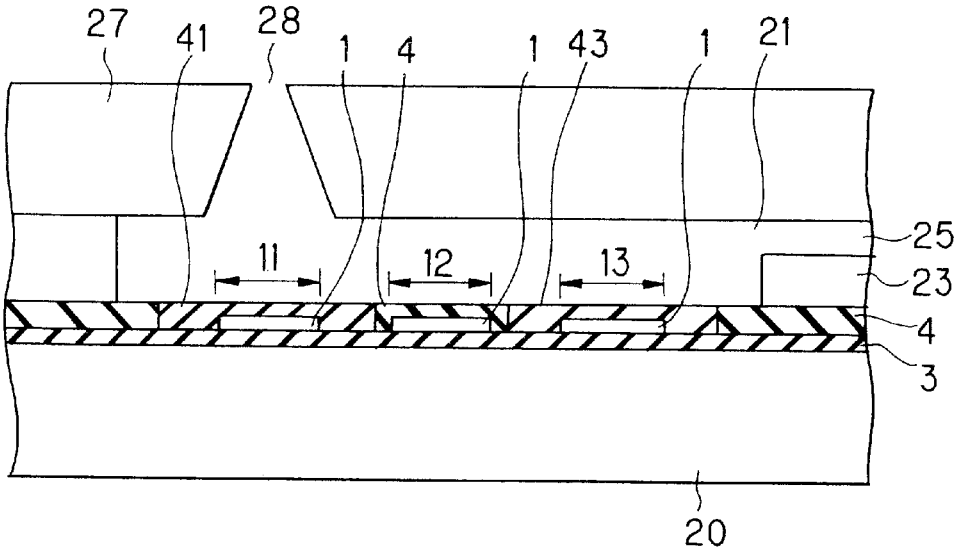
FIG. 5 is a sectional view showing an ink-jet head of the third embodiment in accordance with the present invention.

FIG. 5 shows a configuration of an ink-jet head of this embodiment. This embodiment basically has the same structure as that in the first embodiment, except that there are no differences between insulating films 3 of heating areas 11, 12 and 13, the protective films located on the top of heater films 1 being differentiated instead. In heating area 12, a protective film 4 is formed while another protective film 41 instead of protective film 4 is formed in heating area 11 and still another protective film 43 instead of protective film 4 is formed in heating area 13. Protective films 41 and 43 have almost the same thickness as protective film 4, but are different in thermal conductivity. The three thermal conductivities of the protective films in heating areas 11, 12 and 13, namely $\lambda_1$,$\lambda_2$ and $\lambda_3$, have the relationship: $\lambda_1>\lambda_2>\lambda_3$.

Here, to vary the thermal conductivity of a protective film, the film-forming material for the protective film may and should be changed. For example, protective films 41, 4 and 43 may and should be formed of AlN, $Al_2O_3$ and TaN, respectively, it is possible to provide protective films different in thermal conductivity, similarly to the example of insulating films 31, 3 and 33, explained above in the first embodiment.

(Operation and Effect)

The thermal conductivity of protective film 41 corresponding to heating area 11 is the highest. Accordingly, when three heater films 1 have the same energy simultaneously applied thereto, protective film 4 formed on the top of heater film 1 around heating area 11 undergoes a sharpest temperature rise and hence most quickly runs up to the temperature at which the ink bubbles. Therefore, the thermal efficiencies have the relationship: Th.E. in heating area 11>Th.E. in heating area 12>Th.E. in heating area 13.

Since heating areas 11, 12 and 13 are different in thermal efficiency as above, it is possible to generate bubbles in whole or in part in heating areas 11, 12 and 13, by appropriately selecting the energy level applied thereto. Therefore, the same relationship as that of the first embodiment shown in. FIG. 3 holds between the applied energy and the volume of the ejected ink (the amount of ink droplets), and hence the same effect as in the first embodiment can be obtained.

The Fourth Embodiment (Structure)

Figure 6:
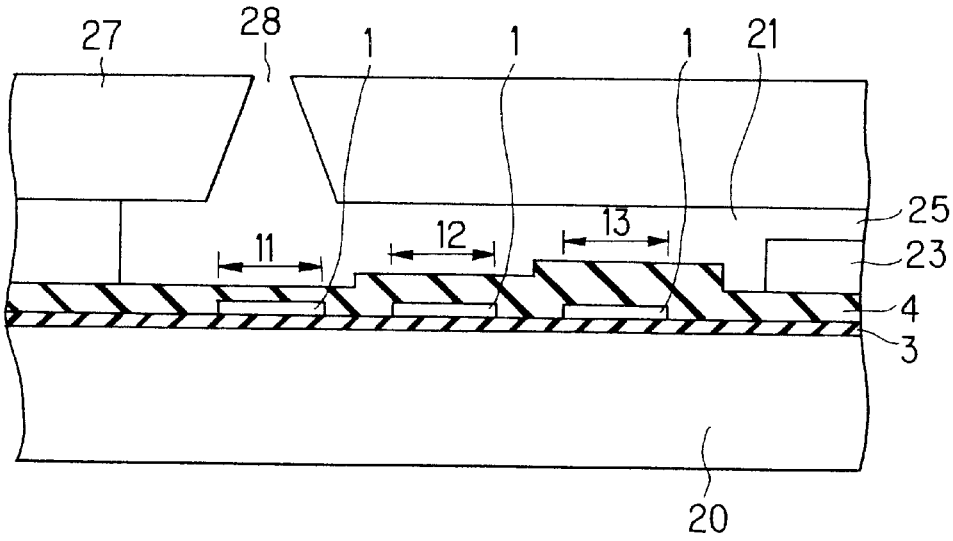
FIG. 6 is a sectional view showing an ink-jet head of the fourth embodiment in accordance with the present invention.

FIG. 6 shows a configuration of an ink-jet head of this embodiment. This embodiment basically has the same structure as that in the third embodiment, except in that there are no differences in thermal conductivity between protective films 4 of heating areas 11, 12 and 13, their thicknesses being made different instead. The three thicknesses of the protective films 4 in heating areas 11, 12 and 13, namely $d_1$, $d_2$ and $d_3$, have the relationship: $d_1<d_2<d_3$. For example, it is possible to provide a specific configuration with $d_1$=5 $\mu$m, $d_2$=10 $\mu$m, and $d_3$=15 $\mu$m.

(Operation and Effect)

Protective film 4 corresponding to heating area 11 is the thinnest. Therefore, when three heater films 1 have the same energy simultaneously applied thereto, protective film 4 formed on the top of heater film 1 around heating area 11 undergoes the sharpest temperature rise and hence most quickly runs up to the temperature at which the ink bubbles. Therefore, the thermal efficiencies have the relationship: Th.E. in heating area 11>Th.E. in heating area 12>Th.E. in heating area 13.

Since heating areas 11, 12 and 13 are different in thermal efficiency as above, it is possible to generate bubbles in whole or in part in heating areas 11, 12 and 13, by appropriately selecting the energy level applied thereto. Therefore, the same relationship as that of the first embodiment shown in FIG. 3 holds between the applied energy and the volume of the ejected ink (the amount of ink droplets), and hence the same effect as in the first embodiment can be obtained.

It is also possible to add the idea of the third embodiment to this embodiment. That is, it is possible to form a multiple number of heating areas having different thermal efficiencies by changing the ratio of $\lambda_i$ to $d_i$ ($\lambda_i/d_i$), where $\lambda_i$ and $d_i$ are the thermal conductivity and the thickness of the protective film. When $\lambda_i/d_i$ is large, the thermal efficiency is high so that it is possible to eject ink droplets with a small application of energy. Conversely, when $\lambda_i/d_i$ is small, the thermal efficiency is low so that ejection of ink droplets needs a large application of energy. Thus, it is also possible to perform multilevel control of the ejected amount of ink droplets by forming a multiple number of heating areas having different thermal efficiencies by varying the ratio $\lambda_i/d_i$.

The Fifth Embodiment

In any of the structures (FIGS. 2, 4 to 6), a multiple number of heating areas having different thermal efficiencies are arranged continuously on a line joining between nozzle 28 and ink supply port 25 with the heating area closest to the nozzle having the highest thermal efficiency. In this case, ink flows, passing over the heating areas, from ink supply port 25 to nozzle 28.

Even when a low amount of ink droplets needs to be ejected and hence when bubbles are generated only in the heating area close to nozzle 28, where it has the higher thermal conductivity, ink is preliminarily heated before the ink reaches the main heating area to a certain degree though it does not reach the temperature at which ink bubbles, passing through the other heating areas where they have lower thermal conductivities. As a result, the energy required for the ink to bubble in the heating area having a high thermal conductivity can be reduced compared to the case where the heating area having a high thermal conductivity is provided solo.

Figure 7:
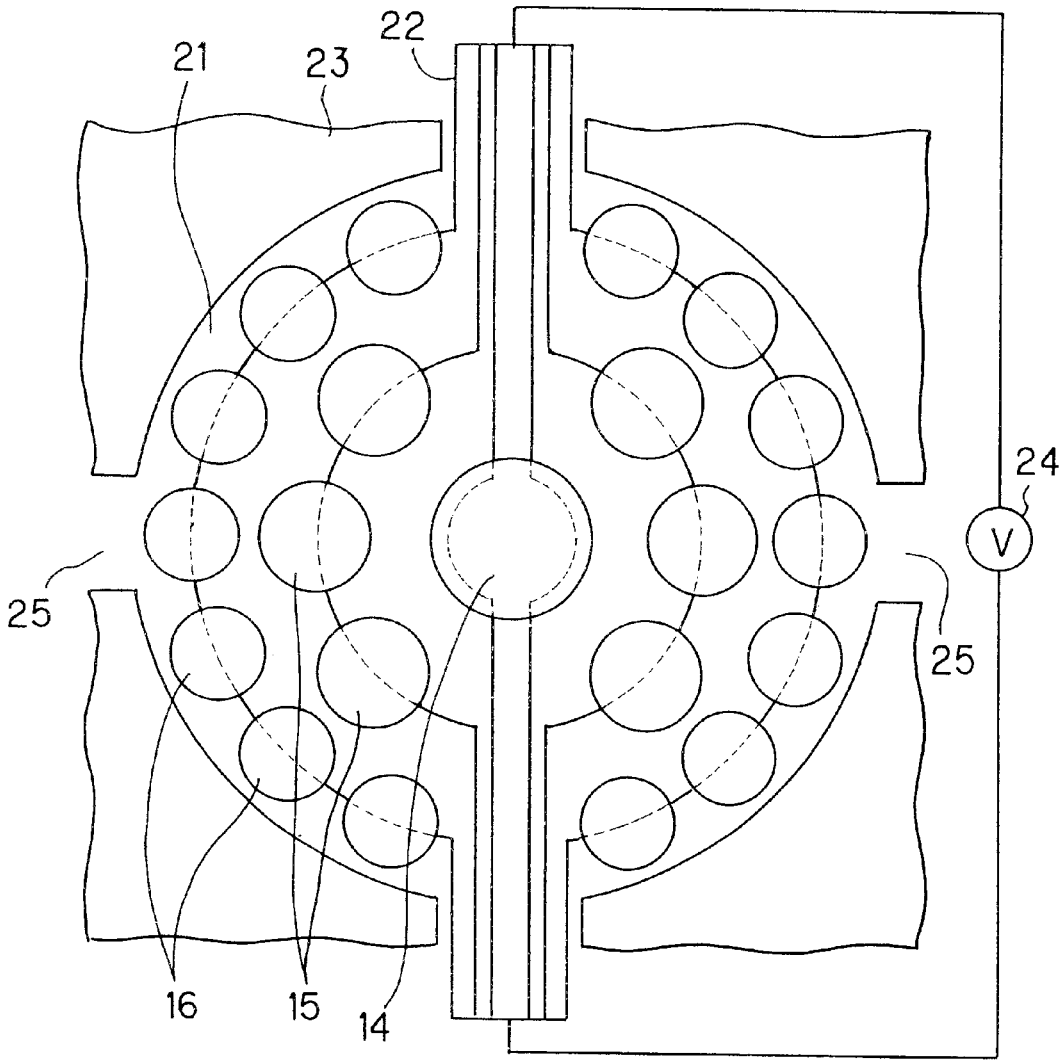
FIG. 7 is a structural view showing an ink-jet head of the fifth embodiment in accordance with the present invention.

The arrangement of the heating areas is not limited to the above configurations. FIG. 7 shows a structure of an ink-jet head in accordance with the fifth embodiment. In this embodiment, heating areas are arranged concentrically. The nozzle is located at the center though it is not shown. The heating area at the center, designated at 14, has the highest thermal efficiency and heating areas, designated at 16, which are located outermost, have the least thermal efficiency. Also in this configuration, when bubbles are generated only at the center or in heating area 14, the same effect as stated above is obtained. That is, ink flowing in through ink supply ports 25 provided at the periphery passes over the heating areas, from the peripheral area to the central part, and is preliminarily heated and bubbles in heating area 14 at the center to eject ink. Though arranged concentrically in the example shown in FIG. 7, a multiple number of heating areas having different thermal conductivities may be arranged in other geometries such as a radial arrangement, etc., as long as they are arranged so that the thermal efficiency gradually become greater from the peripheral area to the central part inside the pressure chamber.

Here, as the means for differentiating the thermal efficiencies of heating areas 14, 15 and 16, the means disclosed in the first to fourth embodiments can be used.

In the first through fifth embodiments, in order to make a difference in thermal efficiency between heating areas, the thermal conductivity and/or thickness of the insulating films and protective films in contact with heating films 1 are made different while the heater films are configured of an identical heater film 1. However, the present invention should not be limited to the above configurations. That is, it is possible to provide difference in thermal efficiency of heating areas by using heater films different in shape, size, thickness and/or material.

All the above embodiments disclosed herein are to be taken as mere examples and not restrictive. The scope of the invention should be defined by the appended claims rather by the preceding description, and all the modifications falling within the scope of the invention and within equivalence of the scope should be embraced.

According to the ink-jet head of the present invention, since a multiple number of heating areas having different thermal efficiencies are provided in a single pressure chamber, it is possible to select heating areas where bubbles should be generated by varying the applied energy level. Therefore, it is possible to perform multilevel control of the ejected amount of ink droplets over a wide range of applied energy. As a result, it is possible to realize recording of multiple tones. Since the heater films contained in the heating areas are electrically connected in parallel, if any one of interconnections connected to one of the heater films is disconnected, the ejection of ink will not stop by the disconnection only, thus making it possible to maintain reliable, high printing quality over a long period of time.

What is claimed is:

1. An ink-jet head for ejecting ink droplets from a nozzle by the pressure caused by bubbles, comprising:

a pressure chamber communicating with the nozzle; and a plurality of heating areas disposed inside the pressure chamber for generating bubbles by heat generation, characterized in that heater films arranged in the heating areas are electrically connected in parallel and the surfaces of the heating areas facing the pressure chamber have different thermal efficiencies.

2. The ink-jet head according to claim 1, wherein each of the heating areas includes an insulating film on the lower side of the heater film and the thermal conductivity of each insulating film is made different from that of the other insulating films so as to produce difference in thermal efficiency.

3. The ink-jet head according to claim 1, wherein each of the heating areas includes an insulating film on the lower side of the heater film and the thickness of each insulating film is made different from that of the other insulating films so as to produce difference in thermal efficiency.

4. The ink-jet head according to claim 1, wherein each of the heating areas includes an insulating film on the lower side of the heater film and the ratio of the thermal conductivity to the thickness of the insulating film is made different from that of other insulating films so as to produce difference in thermal efficiency.

5. The ink-jet head according to claim 1, wherein each of the heating areas includes a protective film on the upper side of the heater film and the thermal conductivity of each protective film is made different from that of the other protective films so as to produce difference in thermal efficiency.

6. The ink-jet head according to claim 1, wherein each of the heating areas includes a protective film on the upper side of the heater film and the thickness of each protective film is made different from that of the other protective films so as to produce difference in thermal efficiency.

7. The ink-jet head according to claim 1, wherein each of the heating areas includes a protective film on the upper side of the heater film and the ratio of the thermal conductivity to the thickness of the protective film is made different from that of other protective films so as to produce difference in thermal efficiency.

8. The ink-jet head according to claims 1 through 7, wherein the heating areas are arranged on a line joining between the nozzle and the ink supply port for supplying ink to the pressure chamber, so that the heating area closest to the nozzle has the highest thermal efficiency and the thermal efficiency varies continuously.

9. A control method of an ink-jet head, comprising the steps of:

using an ink-jet head for ejecting ink droplets from a nozzle by the pressure caused by bubbles, which comprises: a pressure chamber communicating with the nozzle; and a plurality of heating areas disposed inside the pressure chamber for generating bubbles by heat generation, wherein heater films arranged in the heating areas are electrically connected in parallel and the surfaces of the heating areas facing the pressure chamber have different thermal efficiencies; and controlling the applied energy to the heating areas in accordance with the density of the image to be recorded so as to vary the amount of ink droplets and perform recording of tones.

* * * * *